United States Patent [19]

Bernstein

[11] 4,414,528

[45] Nov. 8, 1983

[54] CRIMP FUSE

[75] Inventor: Elliot Bernstein, Rockville Centre, N.Y.

[73] Assignee: Bel Fuse, Inc., Jersey City, N.J.

[21] Appl. No.: 133,331

[22] Filed: Mar. 24, 1980

[51] Int. Cl.[3] ..... H01H 85/16

[52] U.S. Cl. ..... 337/187; 337/231; 337/252

[58] Field of Search ..... 337/187, 190, 199, 205, 337/208, 234, 231, 252

[56] References Cited

U.S. PATENT DOCUMENTS

| | | | |
|---|---|---|---|
| 3,275,774 | 9/1966 | Miller | 337/190 X |
| 3,333,336 | 8/1967 | Cameron et al. | 337/231 X |
| 3,568,122 | 3/1971 | Urani | 337/231 X |
| 3,815,073 | 6/1974 | Pollmeier et al. | 337/231 X |

*Primary Examiner*—George Harris

*Attorney, Agent, or Firm*—Ostrolenk, Faber, Gerb & Soffen

[57] ABSTRACT

A crimp fuse constituting a separate unit independent of the electrical equipment with which it is to be used is disclosed, comprising a length of fuse wire material supported by an insulative rod onto each end of which is crimped a sleeve of e.g. conductive ribbon. An insulative covering, such as a shrunk-on piece of insulative tubing, insulates the wire and provides mechanical strength to the structure. One or both sleeves may be a double sleeve including a female terminal into which e.g. the stripped end of a line cord could be inserted for connection to the fuse. A pigtail may be provided at either or both ends to facilitate soldering.

5 Claims, 4 Drawing Figures

CRIMP FUSE

BACKGROUND OF THE INVENTION

The present invention relates generally to fuses and more particularly relates to fuses to be incorporated into line cord plug or socket assemblies.

It is often desirable that a fuse for inclusion in a plug or socket assembly be manufactured separately therefrom so that the manufacturer of the finished plug or socket assembly can connect the fuse to the plug or socket and to a line cord in whatever manner may be most convenient.

SUMMARY OF THE INVENTION

It is the principal object of the present invention to provide a simple and inexpensive fuse that a manufacturer of plug or socket assemblies can incorporate into such assemblies in any convenient manner.

It is another purpose of the invention to provide a fuse that can be attached to a plug or socket assembly by crimping or by soldering.

It is still another purpose of the invention to provide a fuse that can be attached by either crimping or soldering to a line cord.

According to the present invention a length of fuse wire is crimped at both ends onto a length of a light weight insulative rod. Each crimp is provided by means of a sleeve made of a short length of conductive ribbon that is wrapped around the end of the rod. At least one of the sleeves is provided with a female connection. Alternatively, the fuse assembly can be connected to a plug or socket assembly or to a line cord or to both by soldering. The fuse assembly is covered and protected by means of a layer of insulative material. This may be and preferably is a cylindrical tube of an insulative shrink-on material. In the event that one or both ends of the fuse assembly are to be connected by soldering, the insulative tubing may be made short enough so that part of the crimp sleeve at that end is left exposed, or the crimp sleeve at that end may be provided with a pigtail for soldering.

For the purpose of illustrating the invention, there are shown in the drawings several embodiments which are presently preferred; it is to be understood, however, that the invention is not limited to the precise arrangements and instrumentalities shown.

DETAILED DESCRIPTION OF THE INVENTION

Figure 1:
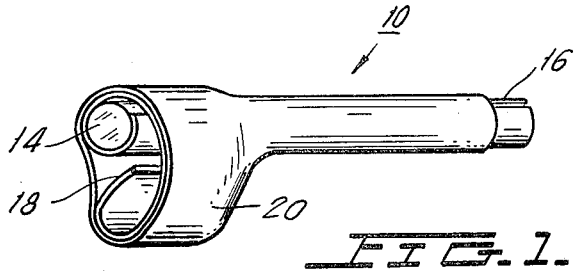
FIG. 1 is a perspective view of a first preferred embodiment of the present invention.
Figure 2:
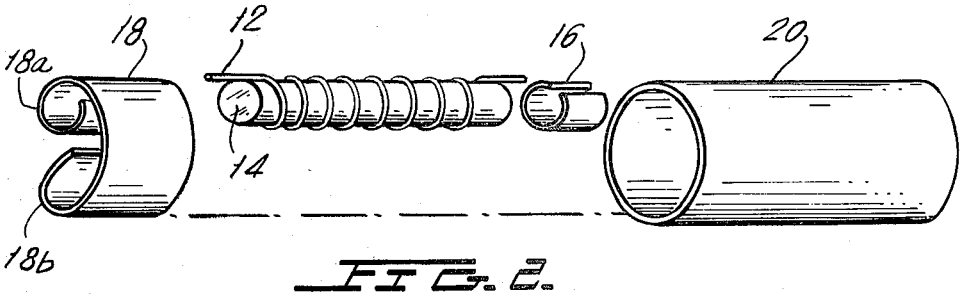
FIG. 2 is an exploded view of the embodiment of FIG. 1.

According to the embodiment shown in FIGS. 1 and 2, the fuse link comprises a length of fuse wire 12. Since the fuse wire 12 may be as little as two mils in diameter, it is virtually impossible to crimp a sleeve directly onto the fuse wire 12. Accordingly, a small plastic rod 14, made for example of the material known by the tradename TEFLON, is provided as shown in FIG. 2. Although teflon is preferred for rod 14 because of its high resistance to temperature, other plastics, or a ceramic, could be used instead, depending on the melting point of the material of which the fuse link 12 is made. The fuse wire 12 may be coiled from one to ten or more times around the plastic rod 14, as in FIGS. 1 and 2, or may simply lie flat therealong. If the wire 12 is coiled on, it may have anywhere from one to ten or more turns, as convenient, around rod 14. Metal sleeves 16, 18 are then crimped onto each end of the rod in good electrical contact with the fuse wire 12. Each crimp sleve 16, 18 is preferably made of a length of metal or other stiff conductive ribbon. Each sleeve 16, 18 may be slipped over one end of the rod 14 and is crimped in place so as to project beyond the end of the rod 14, or may be made flush with the end of the rod 14. In the embodiment of FIGS. 1 and 2, one sleeve 16 has the form of a single cylinder, while the other sleeve 18 is "double-barreled," i.e. it has the shape of two adjacent parallel cylinders 18*a*, 18*b*, one 18*b* of which provides a female terminal for connection to a line cord or blade of a socket assembly, as described below.

The crimp fuse 10 is then insulated and provided with mechanical protection by means of insulative tubing 20. This protective cover may be shrunk on or applied by any other appropriate means. Insulative tape, sleeving, or epoxy or other coating, or a molded insulative housing or insulative fuse could be substituted if preferred. The plastic tubing 20 also serves the function of ensuring that the sleeves 16, 18 remain in place.

The completed crimp fuse 10 can be easily incorporated into an electrical plug assembly. Typically, the crimp fuse 10 will form the connection between a line cord and a prong blade of the plug assembly. The stripped end of the line cord is inserted into portion 18*b* of the double crimp sleeve 18. Alternatively, the stripped end of the line cord may be soldered to crimp sleeve 18. The single crimp sleeve 16 is soldered to a prong blade of the socket assembly. If preferred, single sleeve 16 can be slipped over and crimped onto a tab or tang provided for that purpose on the prong blade. If more convenient, single sleeve 16 can serve as the terminal for the line cord and double sleeve 18 as that for the prong blade.

From the foregoing, it will be understood by those skilled in the art that the crimp fuse 10 of the present invention need not join a line cord to a prong blade, but may be used to connect two sections of the line cord.

Figure 3:
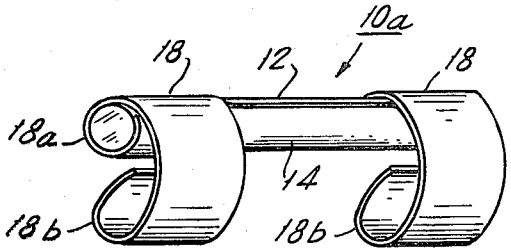
FIG. 3 is a perspective view of a second preferred embodiment without the protective covering.
Figure 4:
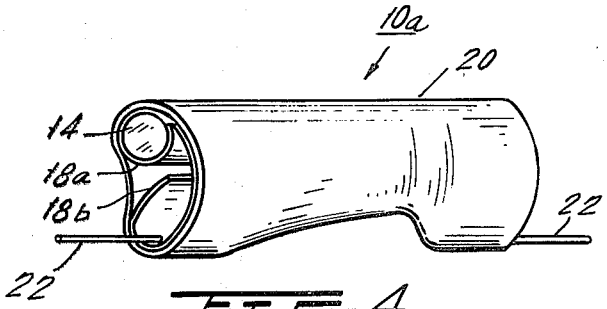
FIG. 4 shows a modification of the embodiment of FIG. 3.

In a second preferred embodiment, shown in FIGS. 3 and 4, a double crimp sleeve 18 is provided at each end of the crimp fuse 10*a*. Note that in this embodiment, the length of fuse wire 12 lies along rod 14 without coiling. In other respects, this embodiment is the same as that of FIGS. 1 and 2, the protective shrink-on cover having been omitted from FIG. 3 for purposes of clarity only. The embodiment of FIG. 3 can be either soldered or crimped onto a line cord, and the user may either solder the other end of the fuse 10*a* to a prong blade or crimp the female opening of part 18*b* of the crimp sleeve 18 at the latter end of the fuse to a prong or tang provided on the prong blade.

According to one method by which the crimp fuse 10 or 10*a* of the invention can be manufactured, a teflon or other insulative rod may be moved by a pair of rollers, the fuse wire being fed alongside the teflon or coiled around the teflon as the latter is fed out. The combination of the insulative rod and the fuse wire is passed through a crimping machine, which crimps pieces of metal ribbon onto the rod, two sleeves being attached for each fuse. The two sleeves of each fuse are spaced apart along the teflon by the length of the fuse 10 or 10*a*, while those of adjacent fuses are very close together.

When a convenient length, e.g. 100 fuses 10 or 10*a* (about three feet), of the teflon-fuse wire combination has been provided with sleeves, a length of protective insulating plastic tubing is shrunk onto the entire assembly, both insulating the fuses 10 or 10*a* and rigidifying the assembly so that it can be handled easily. The 100 fuses 10 or 10*a* are then cut apart simultaneously, in a well-known manner.

As will be clear to one skilled in the art from the foregoing, the metal sleeves 16, 18 or a crimp fuse 10, 10*a* manufactured in this manner will not extend beyond the ends of the teflon rod 14 or beyond the ends of the shrunkon protective tubing 20. To facilitate soldering of such a crimp fuse, a pigtail 22 may be crimped onto one or both sleeves 18, as shown in FIG. 4.

Although several preferred embodiments of the invention have been described in detail, many modifications and variations thereof will now be apparent to one skiled in the art. Accordingly, the scope of the present invention is to be limited not by the details of the preferred embodiments herein described but only by the terms of the appended claims.

What is claimed is:

1. A crimp fuse comprising: a length of fuse wire material;

insulative rod means supporting said length of said fuse wire material;

first and second conductive sleeves crimped onto respective ends of said rod means in good electrical contact with said length of fuse wire material; and an insulative coating covering said length of fuse wire material, said first conductive sleeve including a portion shaped for receiving an electrical conductor to be connected thereto by crimping.

2. The crimp fuse of claim 1, wherein said second conductive sleeve also includes a portion shaped for receiving an electrical conductor to be connected therewith by crimping.

3. The crimp fuse of claim 1, wherein said insulating coating is a shrunk-on plastic coating covering the entire length of said first and second conductive sleeves.

4. The crimp fuse of claim 3, further comprising a conductive pigtail connected said first conductive sleeve.

5. The fuse of claim 1, wherein the porion of the conductive sleeve for receiving an electrical conductor to be connected thereto and the original portion of the conductive sleeve crimped on the end of the fuse constituting a single continuous conductive metallic ribbon formed at one end into said sleeve member to be crimped onto an end of the fuse and the other end being at least partially formed into said shaped portion to be crimped on said conductor.

* * * * *